United States Patent [19]

Quella et al.

[11] Patent Number: 4,890,558

[45] Date of Patent: Jan. 2, 1990

[54] ANCHOR SPREADER

[75] Inventors: Daniel C. Quella, Racine; Michael E. Beach, East Troy, both of Wis.

[73] Assignee: Racine Railroad Products, Inc., Racine, Wis.

[21] Appl. No.: 244,870

[22] Filed: Sep. 14, 1988

[51] Int. Cl.[4] ..... E01B 29/06

[52] U.S. Cl. ..... 104/9; 104/17.2; 104/307; 104/2

[58] Field of Search ..... 104/2, 9, 16, 17.1, 104/17.2, 307

[56] References Cited

U.S. PATENT DOCUMENTS

| | | | |
|---|---|---|---|
| 3,117,530 | 1/1964 | Miller | 104/17.2 |
| 3,117,531 | 1/1964 | Miller | 104/17.2 X |
| 3,121,400 | 2/1964 | Giebel et al. | 104/17.2 |
| 3,132,597 | 5/1964 | Miller | 104/2 |
| 3,272,148 | 9/1966 | McIlrath | 104/2 |
| 3,326,137 | 6/1967 | McTighe et al. | 104/17.2 |
| 3,438,335 | 4/1969 | McIlrath | 104/17.2 |
| 3,722,422 | 3/1973 | Chandre et al. | 104/17.2 |
| 3,841,221 | 10/1974 | Dieringer et al. | 104/17.2 |
| 4,068,593 | 1/1978 | Leeves | 104/17.2 X |
| 4,319,392 | 3/1982 | Cutts | 104/17.2 X |
| 4,320,707 | 3/1982 | McIlrath | 104/17.2 X |
| 4,367,682 | 1/1983 | Freilich et al. | 104/17.2 |
| 4,479,440 | 10/1984 | Burr et al. | 104/17.2 X |
| 4,580,501 | 4/1986 | Collins et al. | 104/17.2 X |

*Primary Examiner*—Douglas C. Butler

*Attorney, Agent, or Firm*—Wood, Dalton, Phillips, Mason & Rowe

[57] ABSTRACT

An anchor spreader having a frame which mounts a head assembly for vertical movement between a raised travel position and a lowered operative position and with the head assembly having spreader members which can be positioned immediately above a tie and inwardly of portions of rail-mounted anchors extending above the tie. The spreader members can be moved apart to shift the rail-mounted anchors along the rail away from the tie to achieve the anchor spreading. Positive clamp structure securely holds the head assembly in position longitudinally of the rail whereby the head assembly can remain in fixed position regardless of the reaction to forces exerted in spreading one or more rail mounted anchors.

15 Claims, 8 Drawing Sheets

R
16
12
15
10
25
29
28
24
21
23
22
53
52
45
31
46
32
38
3
20
101
100
41
79
78
34
35
77
76
30
33
58
59
39
90
91
81
83
7
4

ANCHOR SPREADER

DESCRIPTION

1. Field of the Invention

This invention relates to an anchor spreader for spreading rail-mounted anchors whereby rail-mounted anchors may be moved away from a tie, while still mounted to a rail, to enable tie removal and replacement.

2. Background of the Invention

A rail anchor clamps onto a rail and is positioned to abut a vertical face of a tie whereby there is resistance to longitudinal movement of a rail relative to the supporting tie.

For many years, there have been machines for setting and applying rail anchors. This type of equipment is shown in the Miller U.S. Pat. No. 3,117,530 and the Miller U.S. Pat. No. 3,132,597. Additional equipment of this type is shown in the McIlrath U.S. Pat. Nos. 3,272,148 and 3,438,335. Equipment for applying a clip, rather than an anchor, is shown in the McIlrath U.S. Pat. No. 4,320,707.

The foregoing types of equipment result in placing rail-mounted anchors in close abutting relation with opposite vertical faces of a tie. When a tie is to be replaced, it is necessary to shift the tie-abutting rail-mounted anchors lengthwise of the rail to positions away from the tie, so that a tie remover can longitudinally withdraw the tie from beneath the rail, followed by tie replacement and return of the rail-mounted anchors to tie-abutting positions. This return of the anchors to tie-abutting positions could be accomplished by use of a rail anchor relocator, such as shown in the Miller U.S. Pat. No. 3,117,531.

An anchor spreader to spread the rail-mounted anchors away from a tie contributes to further mechanization of the operations required in track maintenance programs.

SUMMARY OF THE INVENTION

A primary feature of the invention is to provide an anchor spreader effective to engage portions of a pair of rail-mounted anchors at opposite sides of a tie and forcibly move the anchors lengthwise of the tie to positions spaced from sides of the tie.

In carrying out the foregoing, the anchor spreader has a vehicle frame movable along a track and which movably supports a head assembly which can be lowered into position to position spreader plates in alignment with portions of a pair of rail-mounted anchors exposed above a tie, followed by movement of the spreader plates in a direction to force the rail-mounted anchors away from the tie.

The anchor spreader includes rail clamping means for the head assembly to maintain proper location of the head assembly along the rail and to also enable effective operation if the anchor spreader acts only on a single rail-mounted anchor with a resulting reaction force tending to move the anchor spreader lengthwise of the rail. Additionally, means are provided for coaction between the frame and the head assembly to control the lower position of the head assembly relative to the frame to accommodate different rail heights and to limit the separating movement of the spreader plates.

An object of the invention is to provide an anchor spreader for spreading one or more rail-mounted anchors away from a tie comprising, a frame, a head assembly movably mounted on said frame for vertical movement toward and away from a tie, and spreader means movably mounted on said head assembly for engaging a pair of rail-mounted anchors at a level above the tie and moving the anchors oppositely along the rail away from the tie to spread the anchors.

Another object of the invention is to provide an anchor spreader as defined in the preceding paragraph including releasable means on said head assembly for clamping the rail to hold the head assembly against movement longitudinally of the rail during spreading of the anchors.

A further object of the invention is to provide an anchor spreader as defined in the preceding paragraphs wherein said spreader means includes a plurality of fluid cylinders, said releasable clamping means includes a hydraulic cylinder, and a circuit including a pressure switch associated with the hydraulic cylinder to assure rail clamping before operation of the fluid cylinders to spread the anchors.

An additional object of the invention is to provide an anchor spreader as defined in the preceding paragraphs wherein the frame has adjustable means for setting the lowered position of the head assembly to take into account variations in the height of the rail with which the anchor spreader is used and further wherein means are interposed between the spreader bars and a head guide member to limit movement of the spreader bars away from the head plate.

DESCRIPTION OF THE PREFERRED EMBODIMENT

Figures 1, 2:
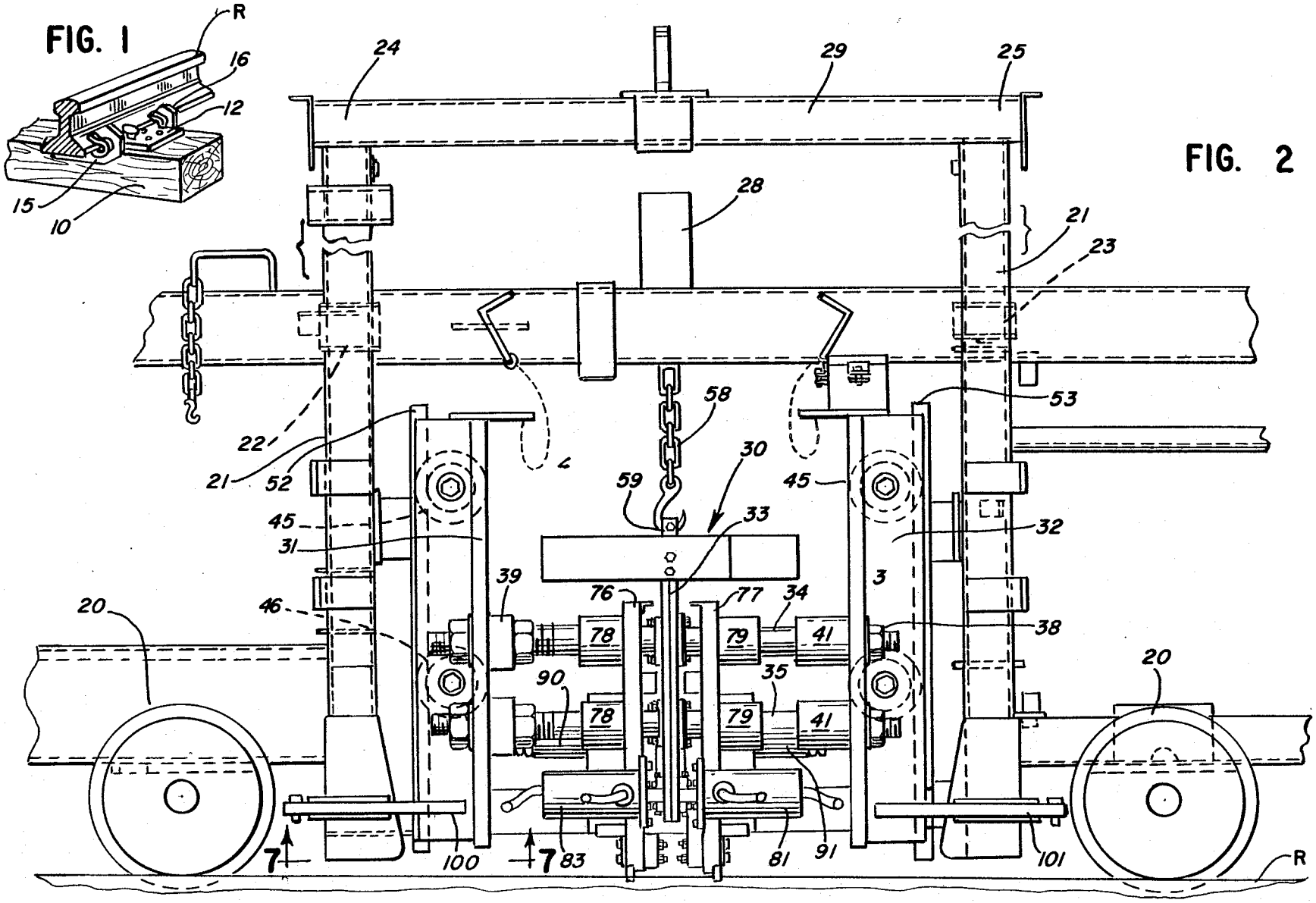
FIG. 1 is a fragmentary perspective view showing a rail and tie and associated structure.
FIG. 2 is a fragmentary side elevational view of the anchor spreader, with the head assembly thereof in raised position to enable travel along the railroad track.
Figure 3:
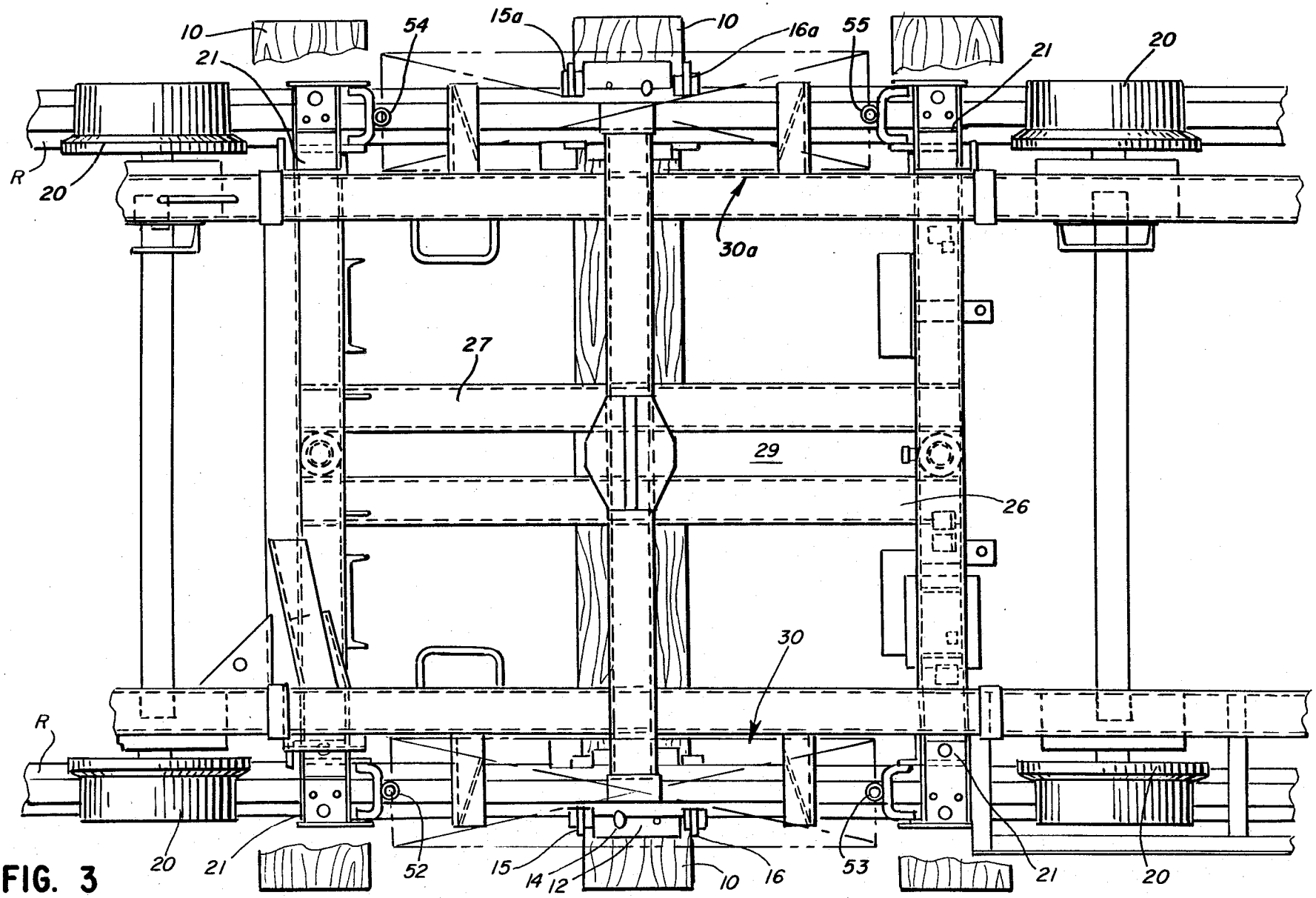
FIG. 3 is a fragmentary plan view of the vehicle frame structure shown in FIG. 2 and with the frame positioned to provide for spreading of two pairs of rail-mounted anchors adjacent opposite ends of a tie.
Figure 4:
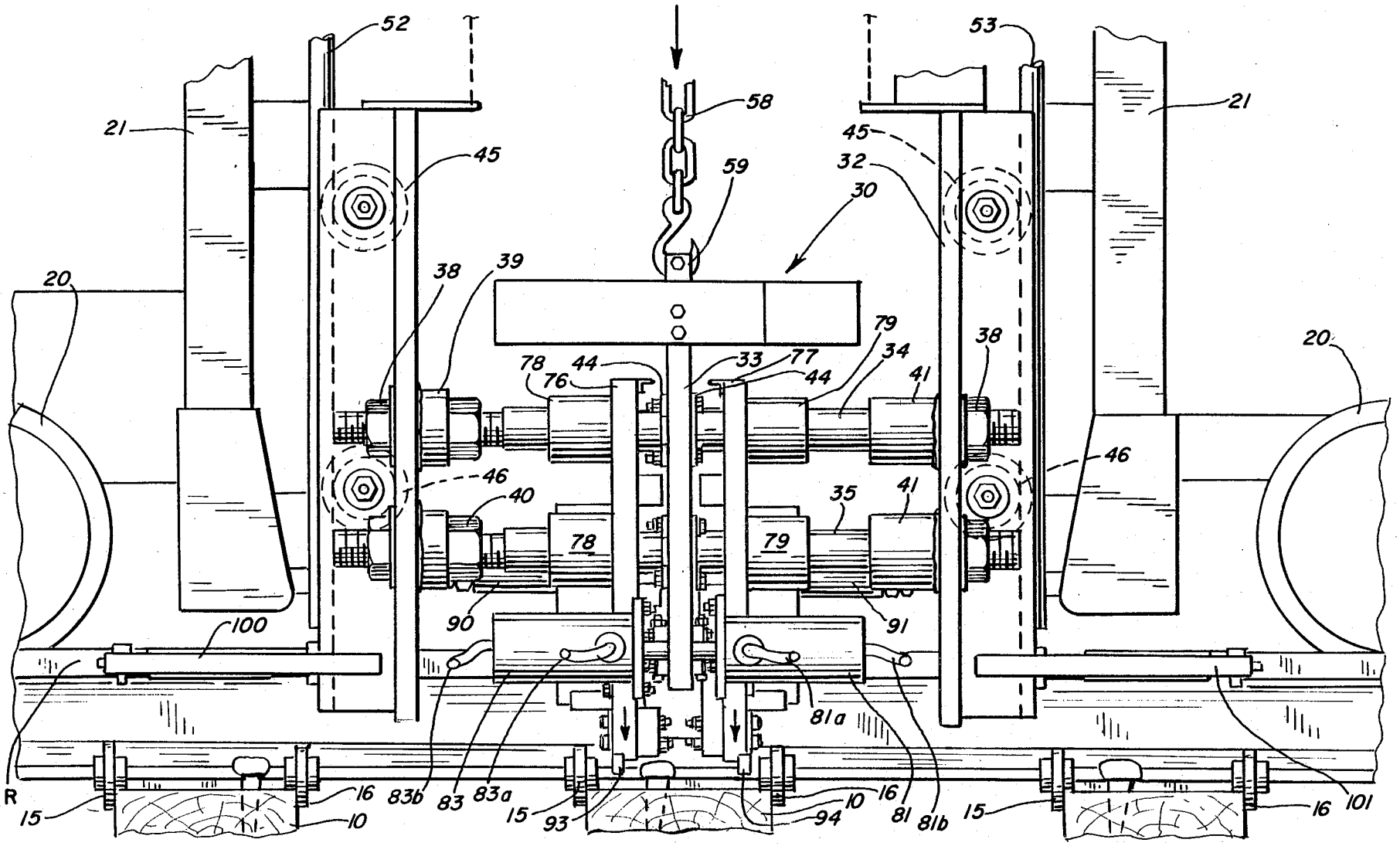
FIG. 4 is a fragmentary side elevational view of the anchor spreader showing a position of the structure shown in FIG. 2 on an enlarged scale and with the head assembly in a lowered position.

Several of the drawing Figures show track structure including a rail and a tie and associated structure including a tie plate and rail-mounted anchors. As seen in FIGS. 1, 3 and 4, a tie 10 has a tie plate 12 secured thereto by a rail spike 14. A rail R is mounted on the tie plate and a pair of rail-mounted anchors 15 and 16 abut opposite sides of the tie. As seen in FIG. 3, there can be similar associated structure adjacent the opposite end of the tie including a tie plate 12*a* and rail anchors 15*a*and 16*a*. FIG. 4 of the drawings shows that a series of ties 10 spaced lengthwise of the rail R can each have the structure as described in connection with FIG. 1.

Figure 5:
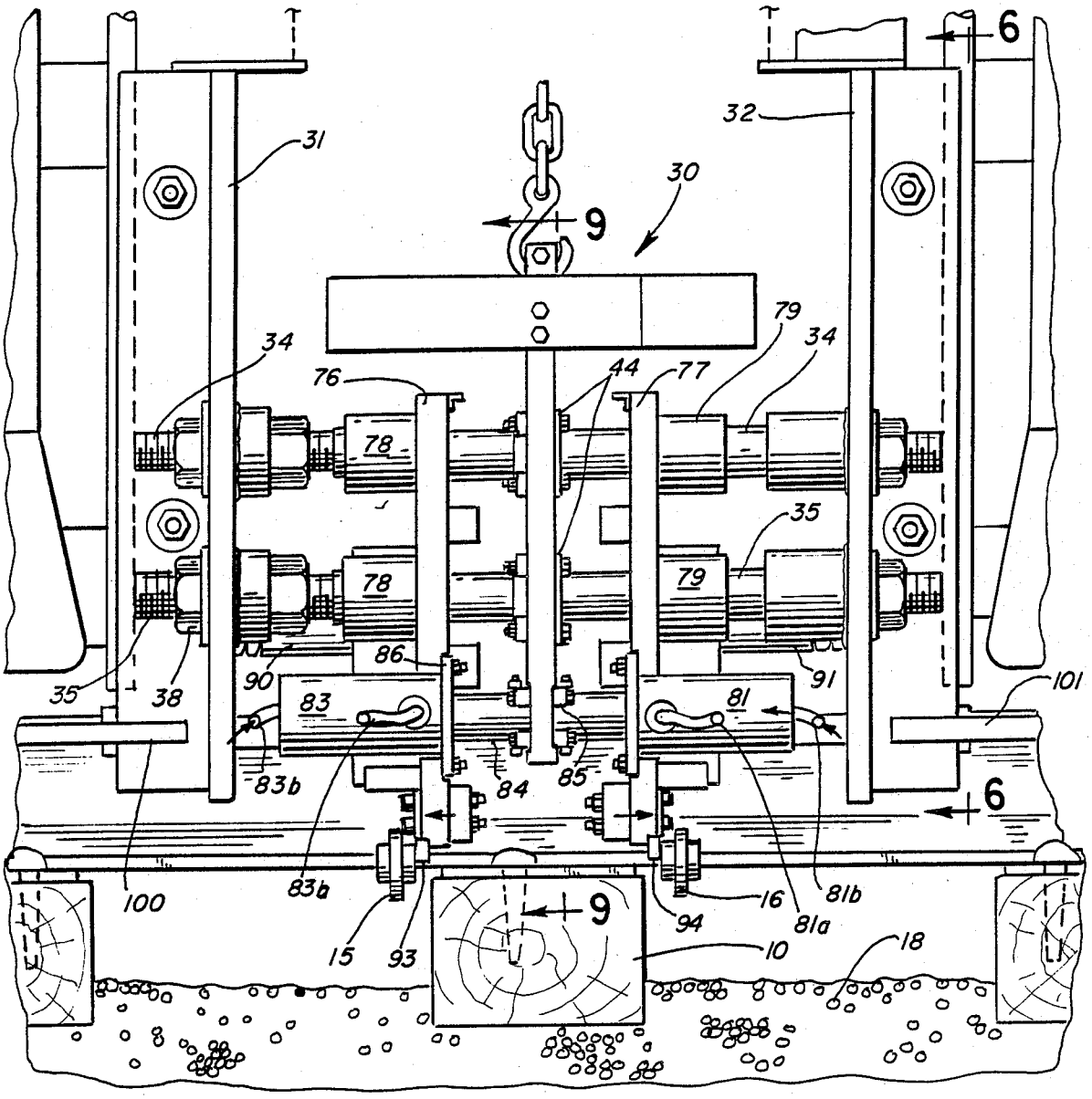
FIG. 5 is a fragmentary side elevation of a par of the structure shown in FIG. 4 and showing the completion of the anchor-spreading operation.

The function of the anchor spreader is to spread anchors 15 and 16 from the tie-abutting position shown in FIGS. 3 and 4 to the spread position at a distance from opposite sides of the tie 10 as shown in FIG. 5. This frees the tie 10 for lengthwise removal from the ballast 18 preparatory to tie replacement.

The anchor spreader, as seen in FIGS. 2–4, has a vehicle chassis rotatably mounting rail-engaging wheels 20 for lengthwise positioning of the anchor spreader along the track and has upright members 21 at the four corners of the frame mounting transverse members 22 and 23 at an intermediate height and transverse member 24 and 25 at the top thereof, with the transverse members 22 and 23 at the intermediate height supporting a pair of longitudinally-extending members 26 and 27 which mount a head lift cylinder 28. The uppermost transverse members 24 and 25 mount a longitudinally-extending beam 29.

A head assembly, indicated generally at 30, is movably supported on the frame for vertical movement between a travel position, shown in FIG. 2, and an operative position, shown in FIGS. 4 and 5.

The head assembly has a pair of spaced-apart head guide members 31 and 32 with a vertically-disposed head plate 33 therebetween.

The head guide members 31 and 32 are rigidly interconnected to each other and with the head plate 33 by means of a plurality of horizontally disposed head rods 34-37 which, as best seen in FIG. 4, extend through openings in these components and have threaded ends to receive nuts 38.

The head rods 34-37 extend through sleeves 39 fixed to the head guide member 31 and are longitudinally located relative thereto by additional nuts 40 threaded thereon. Additionally, the head rods 34-37 extend through sleeves 41 fixed to the head guide member 32.

Figure 9:
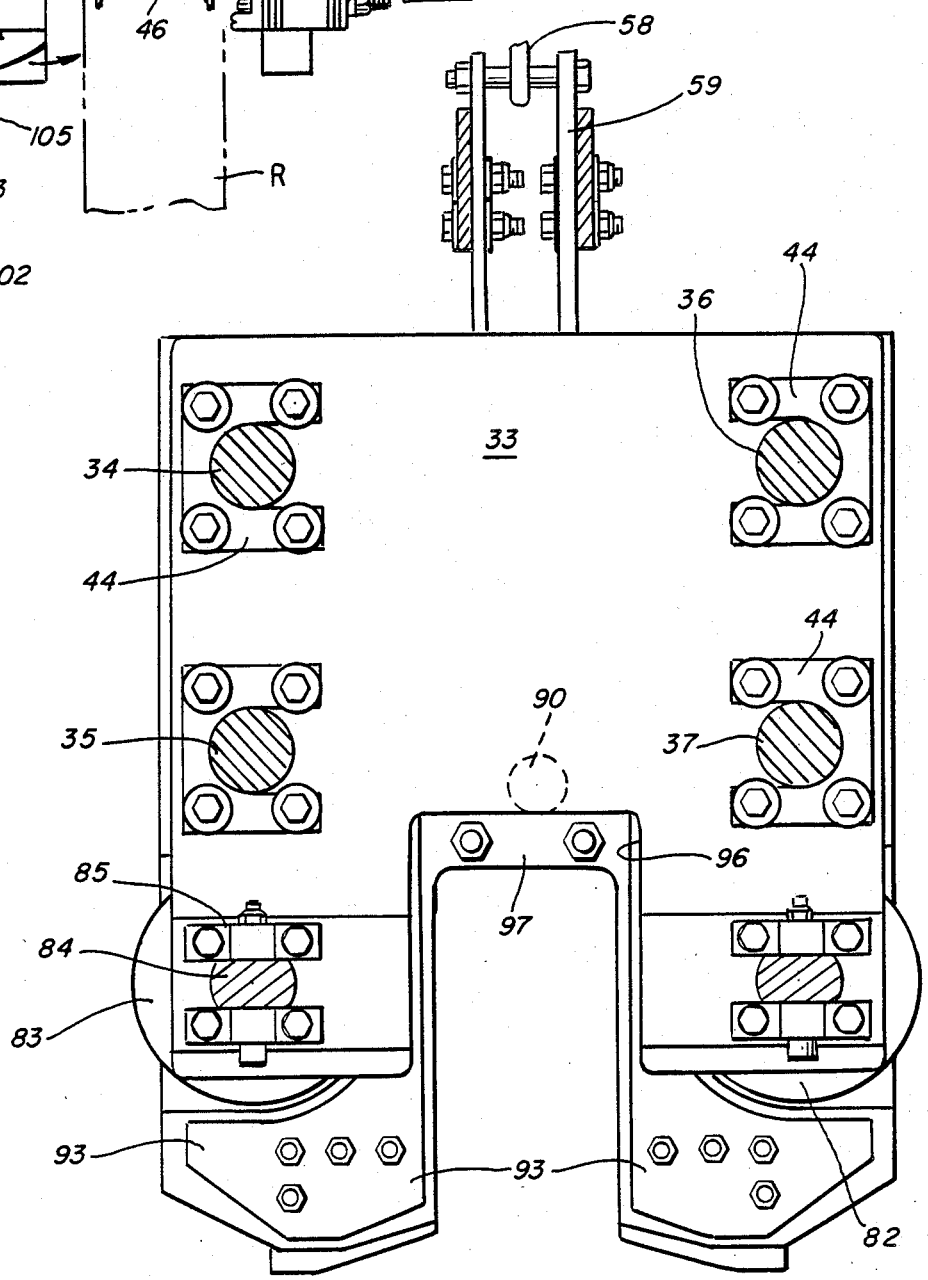
FIG. 9 is a vertical section on an enlarged scale, taken generally along the line 9—9 in FIG. 5.

U-shaped plates 44, as seen particularly in FIG. 9, are positioned at each side of the head plate 33 and coact with grooves in the head rods to interconnect the head plate to the central positions of the head rods.

Figure 6:
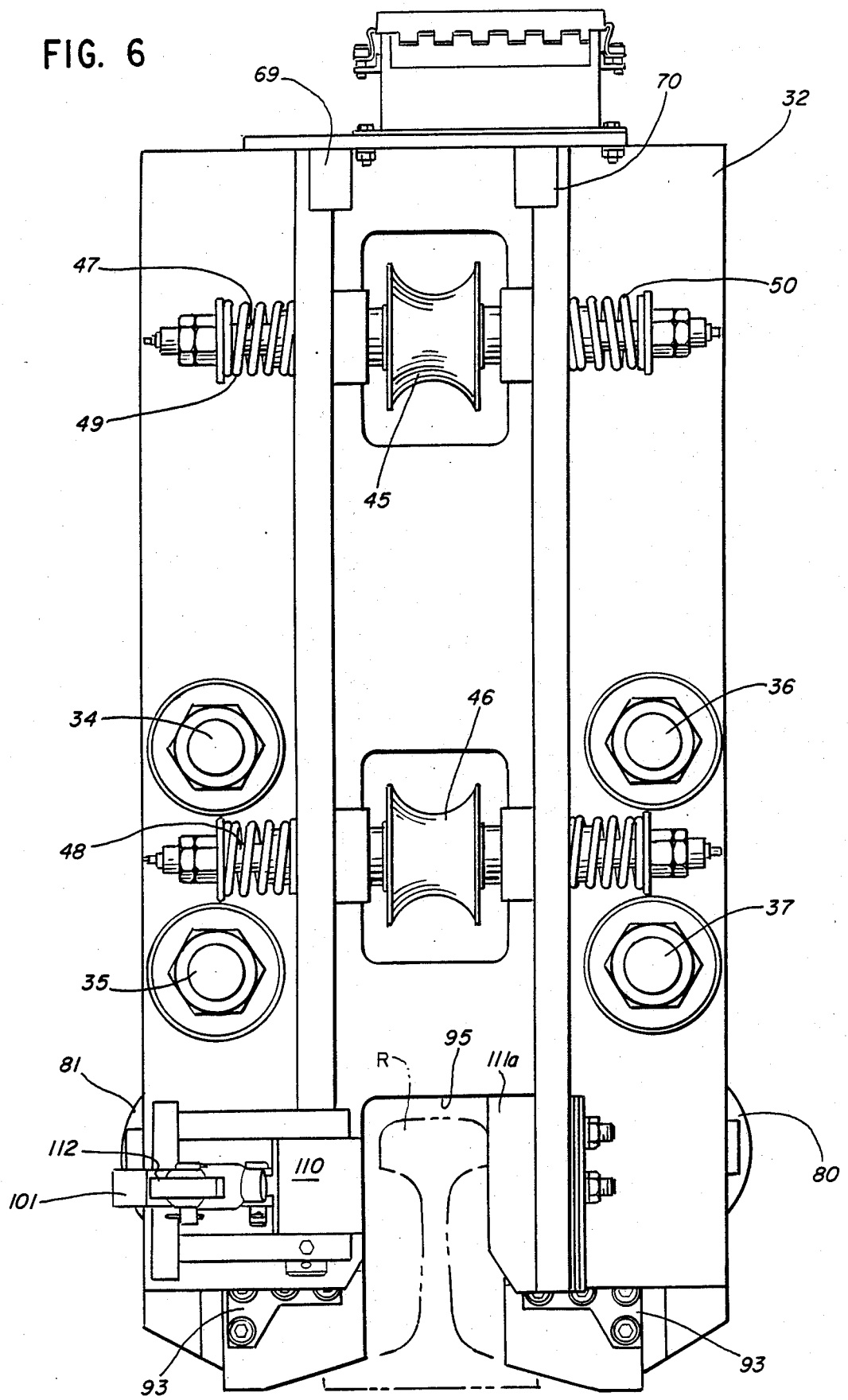
FIG. 6 is a vertical section on an enlarged scale, taken generally along the line 6—6 in FIG. 5.

The head guide members 31 and 32 are of the same construction, with the head guide member 32 being shown particularly in FIG. 6. A pair of guide rollers are rotatably mounted on the head guide member at vertically-spaced locations including an upper guide roller 45 and a lower guide roller 46. The guide rollers are mounted on respective shafts 47 and 48 which are spring-loaded by a pair of opposed springs 49 and 50 to a centered position, as shown in FIG. 6, but which can move axially to permit some lateral movement from the centered position.

The guide rollers 45 and 46 coact with fixed guide rods 52 and 53 extending vertically along the corner frame members 21 of the chassis.

In order to spread the anchors adjacent both ends of the tie the vehicle has two of the head assemblies with a second head assembly indicated generally at 30*a*. The head assembly 30*a* is identical to the head assembly 30 which is described herein in detail. The head assembly 30*a* would have the guide rollers movable along the guide rods 54 and 55 (FIG. 3) supported by two of the corner frame members 21.

The cylinder 28 has a rod connected to a chain 58 connected to a bracket 59 secured to an upper end of the head plate 33 whereby the head assembly may be moved vertically between the travel position shown in FIG. 2 and the operative position shown in FIGS. 4 and 5. The anchor spreader frame is above a tie at a distance depending upon the height of the rail R because of the support therefrom by the vehicle wheels 20. Rails of varying height are used and, therefore, the anchor spreader must have means for adjusting the lowered position of the head assembly 30 relative to the frame in order to assure that the lowered position of the head assembly has operative components thereof positioned immediately above the tie regardless of rail height. This height adjustment structure is shown in FIGS. 10 and 11.

The height adjustment means for controlling the lower operative position of the head assembly comprises a pair of vertically adjustable brackets mounted on the frame and which coact with stop members carried on the head guide members of the head assembly.

Figure 10:
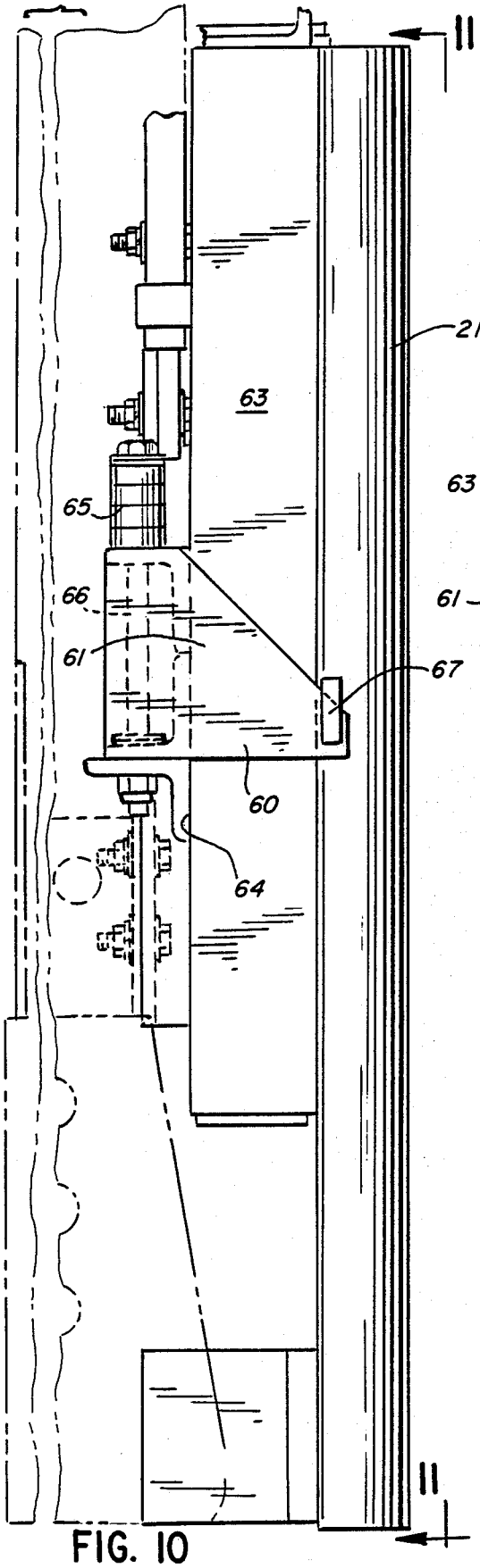
FIG. 10 is a fragmentary elevational view of the structure for setting the lowered position of the head assembly.
Figure 11:
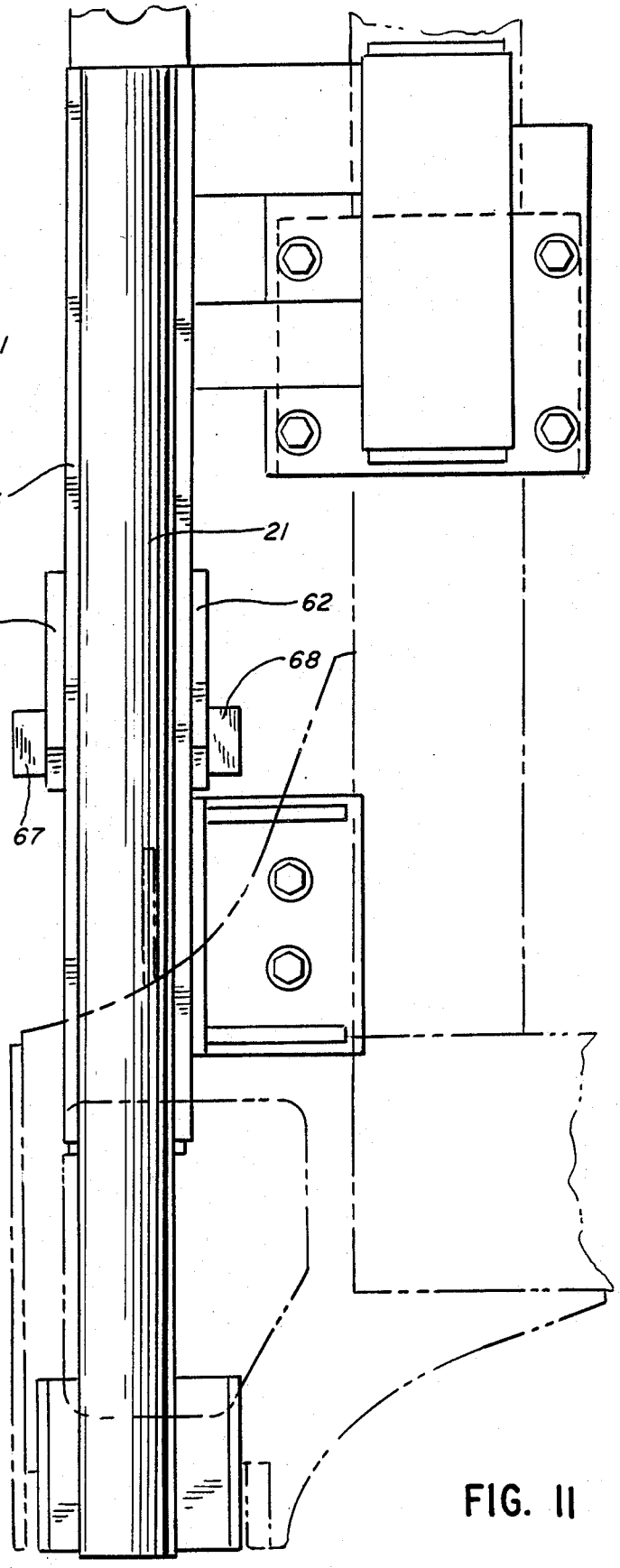
FIG. 11 is a view of the structure shown in FIG. 10, taken in the direction indicated by the line 11—11.
Figures 12, 13:
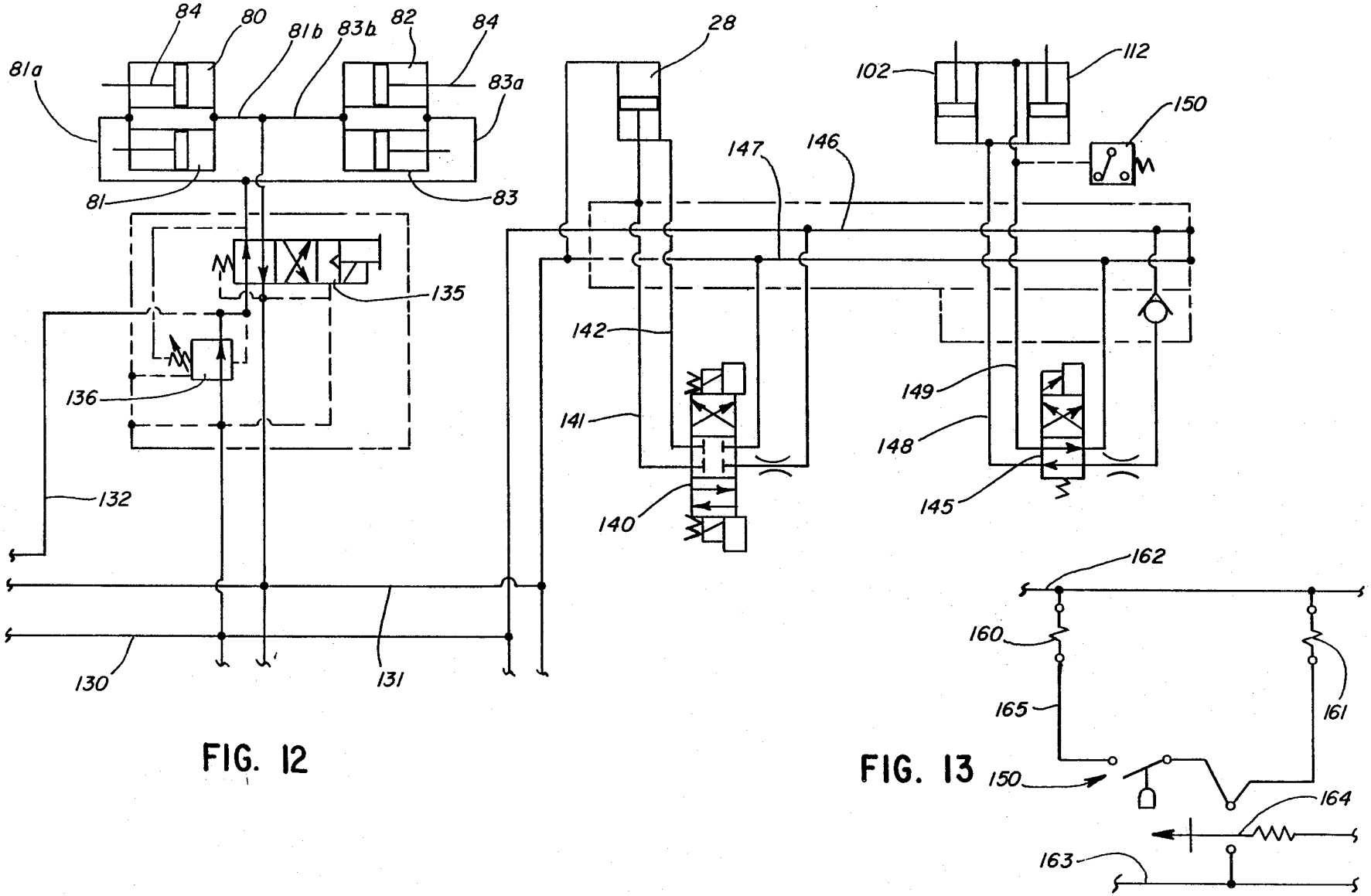
FIG. 12 is a hydraulic circuit schematic.
FIG. 13 is a showing of a portion of the electrical circuit for the anchor spreader.

More particularly, as seen in FIGS. 10 and 11, a bracket 60 has flanges 61 and 62 which span a member 63 fixed to a frame corner member 21. The bracket 60 can be adjusted vertically relative to an angle member 64 fixed to member 63 by positioning a selected number of the spacers 65, shown captured on a rod 66, between the underside of the bracket and the angle member 64. The bracket 60 has spaced horizontal sections with a hole to movably mount the bracket on the rod 66. A pair of stop members 67 and 68 on the bracket 60 are in position to align with stop members 69 and 70 fixed to the top of a head guide member (FIG. 6).

A head assembly may move downwardly until the stop members 69 and 70 on the two head guide members engage the stop members 67 and 68 on the two brackets 60 which results in setting the height of the head assembly relative to the frame. The foregoing height adjustment structure is duplicated at both the front and the rear of a head assembly whereby both of the head guide members have the members 69 and 70 for coacting with a pair of vertically adjustable brackets 60 mounted to two of the frame corner members 21 of the machine.

The head assembly further includes a pair of spreader bars or plates 76 and 77 each having four sleeves 78 and 79, respectively, fixed thereto and which are movable on the head rods 34-37 whereby the spreader bars can move from their retracted position, shown in FIG. 4, to their extended position, shown in FIG. 5. This movement between the two positions is achieved by operation of a plurality of hydraulic cylinders. There are four hydraulic cylinders 80-83, as seen in the hydraulic circuit of FIG. 10, located at the four lower corners of the head assembly 30. Two of the cylinders, 81 and 83, as seen in FIGS. 2, 4 and 5, have a common piston rod 84 secured intermediate its ends to the head plate 33 and the barrels of the cylinders 81 and 83 are secured to the lower ends of the spreader bars 76 and 77. By the control of hydraulic fluid through the cylinder line 81*a* and 81*b* and 83*a* and 83*b* the spreader bars are caused to move toward and away from the head plate 33, as more particularly described in connection with FIG. 10. The connection of the central part of the piston rod 84 to the head plate 33 is by connecting members 85 and the cylinder barrels are connected to the spreader bars 76 and 77 by mounting brackets 86 and 87.

The extension of the cylinder barrels relative to the piston rods to separate the spreader bars 76 and 77 is controlled by horizontal movement limit stops in the form of a pair of rods 90 and 91 extending outwardly from spreader bars 76 and 77, respectively, and which move from a position shown in FIG. 2 to a position abutting the head guide members 31 and 32 in FIG. 5 to limit the movement of the spreader bars 76 and 77 in spreading the rail anchors.

Each of the spreader bars 76 and 77 has provision for mounting spreader plates (tool plates) 93,94, respectively, which can have the necessary shape to coact with that portion of the rail anchors 15 and 16 which extend above the top of the tie and exert force thereon to move the anchors from the position shown in FIG. 4 to the position shown in FIG. 5.

Different shape anchors are used by different railroads and the detachable mounting of the spreader plates 93 and 94 enables the use of single or double spreader plates shaped appropriately for coacting with the particular shape of rail anchor. As seen in FIG. 6, the head guide members are upwardly recessed centrally thereof, as shown at 95 for the head guide member 32, to avoid interference with a rail R and, similarly, the head plate 33, as seen in FIG. 9, and the spreader bars 76 and 77 are upwardly, centrally recessed at 96 and 97, respectively, for noninterference with a rail R when in lowered position.

The head assembly further includes rail-clamping means for releasably clamping a rail in two spaced-apart locations which are effective to hold the head assembly against movement longitudinally of a rail during the anchor spreading operation. The forces required to spread the anchors 15 and 16 may not necessarily be equal and opposite, which could result in an imbalance of forces tending to move the anchor spreader longitudinally of the rail. If the anchor spreader is operating against only a single anchor, the rail clamping means must hold the anchor spreader in position on the rail against the reaction to the spreading force.

Figure 7:
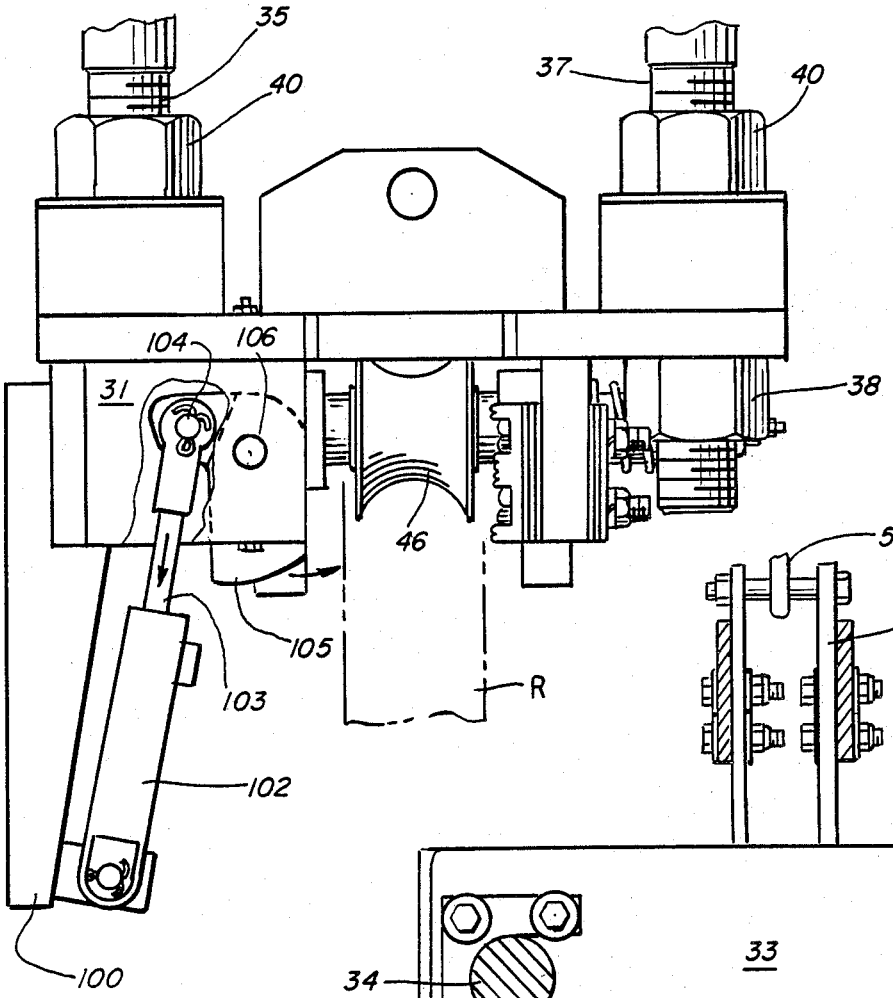
FIG. 7 is a fragmentary bottom plan view, taken generally along the line 7—7 in FIG. 2 and on an enlarged scale.

The rail clamping means includes a pair of brackets 100 and 101 extending forwardly and rearwardly, respectively, from the head guide members 31 and 32 and with the bracket 100 and associated structure being shown particularly in FIG. 7. The bracket 100 at an end thereof pivotally mounts a hydraulic cylinder 102 having a piston rod 103 pivotally connected at 104 to a rail clamp 105 which is pivotally mounted to the head guide member at 106. An anvil 111 fixed to the head guide member engages the opposite side of the rail and opposes the force exerted by the clamp 105.

The other rail clamp associated with the mounting bracket 101 is shown in FIG. 6 and has a rail clamp 110, controlled by cylinder 112, which exerts a clamping force against the rail as opposed by an anvil 111*a* fixed to the lower opposite side of the head guide member 32. The rail clamp 110 is shown in retracted position as a result of extension of the piston rod outwardly of the actuating cylinder 112.

Figure 8:
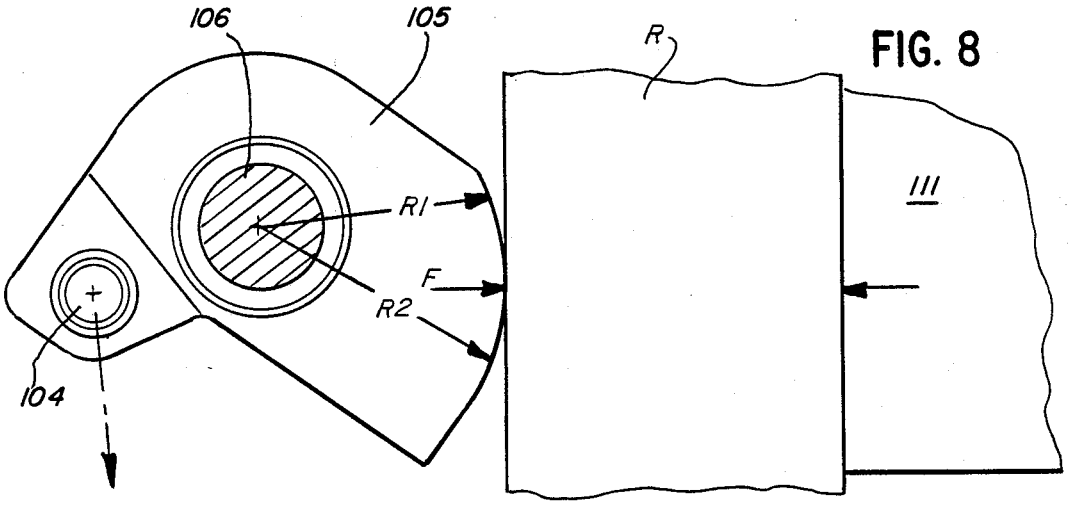
FIG. 8 is a diagrammatic view of the portion of the rail-clamping mechanism shown in FIG. 7 to illustrate the clamping action thereof.

As seen in FIG. 8, a clamp surface 115 of the clamp member 105 has a curved surface with a gradually increasing radius R1 to radius R2 relative to the pivoting at 106 and the clamp member 105 is oriented whereby a force tending to move the anchor spreader in a direction to pivot the clamp 105 counterclockwise will tend to increase the clamping force against the anvil 111. The clamp member 110 is of a similar shape and properly oriented to increase clamping force when the anchor spreader tends to move in a direction opposite to that described in connection with the increasing clamping force of clamp member 105.

It is believed the operation of the anchor spreader will be readily understood from the foregoing description. However, it may be briefly summarized as follows. The anchor spreader is brought to a desired location along the rails to have the head assemblies overlie a tie, with the head plates 33 generally aligned with the center line of the tie. A head assembly is then lowered from the travel position to the operative position shown in FIGS. 4 and 5, as established by the height-setting means previously described, and the operator actuates a switch to commence the spreading operation. The first action in the spreading sequence is the actuation of the rail clamping means by operation of the cylinders 102 and 112 and, after the rail is clamped, the cylinders 80-83 are operated to spread the spreader bars 76 and 77 whereby the spreader plates 93 and 94 move the rail-mounted anchors 15 and 16 from the position shown in FIG. 4 to the spread position shown in FIG. 5. The spreading stroke of the spreader plates is controlled by the horizontal limit stops 90 and 91. Deactivation of the operator's switch causes retraction of the spreader bars and release of the rail clamping means. The head assemblies can then be elevated whereby the anchor spreader can be advanced to the next tie having rail-mounted anchors that are to be spread.

The circuitry for performing the operations of the anchor spreader as previously described is shown in the hydraulic circuit of FIG. 10 and the electrical circuit of FIG. 11.

The hydraulic circuit includes a pressure line 130 and a tank line 131 and a gauge line 132.

A solenoid-operated four-way valve 135 controls communication of the pressure and tank lines with the four spreader cylinders 80-83. With the solenoid deenergized, the four-way valve 135 is positioned as shown in FIG. 10 whereby all of the spreader cylinders are connected to the pressure and tank lines in a manner to have the spreader bars in their retracted position. More particularly, pressure in line 130 passes through the valve 135 to the lines 81*a* and 83*a* to cause the cylinders 81 and 83 to move toward each other as viewed in FIG. 5. When the solenoid valve is shifted by energization of the solenoid, pressure fluid is delivered through lines 83*b* and 81*b* to cause the cylinder barrels to extend relative to the piston rod 84. A pressure-reducing valve 136 is associated with the four-way valve 135.

Control lines 141 and 142 extend from a solenoid-actuated spring-centered four-way valve 140 with control line 141 being blocked and control line 142 being connected to the cylinder 28. Since the head assembly can be lowered in response to gravity, it is only necessary to connect the lower side of the cylinder to pressure when it is desired to lift the head assembly. The valve 140 can be shifted to accomplish either lifting of the head assembly or to permit lowering thereof by actuation of one or the other of the solenoids of the valve, with the solenoids being connected in a conventional circuit being subject to control by an operator for either lifting or lowering the head assembly.

The rail clamp cylinders 102 and 112 are under the control of a solenoid-operated four-way valve 145 connected to extensions 146 and 147, respectively, of the pressure and tank lines and having a pair of control lines 148 and 149 which extend to opposite ends of the cylinders 102 and 112 which are connected in parallel. When the solenoid of the four-way valve 145 is energized, the four-way valve shifts to a position whereby pressure is delivered to control line 149 which causes retraction of the rods of the cylinders to bring the rail clamps into clamping engagement against a rail. A pressure responsive switch 150 connected into the control line 149 senses an increase in pressure when the rail clamps are tightly engaged against the rail. The cylinders are connected in parallel whereby the single pressure switch 150 can sense effective engagement of a rail by both rail clamps. Deenergization of the solenoid of the valve 145 results in reversal of the connections whereby pressure is delivered to the cylinders 102 and 112 through the control line 148 to release the rail clamps.

The foregoing hydraulic circuit is duplicated for the spread cylinders, the lift cylinder, and the rail clamp cylinders for the head assembly 30*a* for spread of anchors at the opposite end of the tie, with there being connections to the pressure line 130 and tank line 131.

FIG. 11 shows the components in the electric circuit for assuring operation of the spreader plates only after clamping of a rail. The electrical components include the coil 160 of the solenoid for the four-way valve 135 for operating the spread cylinders and a coil 161 for the solenoid of the four-way valve 145 for operating the clamp cylinders 102 and 112. These coils are in parallel across lines 162 and 163 and in series with a normally open switch 164 which may be closed by an operator to initiate the spreading cycle after the head assembly has been lowered into position. Upon closure of the switch 164 the coil 161 for the valve 145 for controlling the rail clamping cylinders is energized to commence the clamping operation. The pressure switch 150 is connected into a line 165 having the switch 164 and the coil 160 for the valve 135 for the spread cylinders and is normally open. When the pressure rises to a level indicating that the rail clamps are fully effective, the pressure switch 150 closes which results in energization of the coil 160 for the solenoid of the four-way valve 135 whereby the spread cylinders 80-84 are caused to operate to spread the rail anchors. Opening of the switch 164 by the operator will result in deenergization of the coils 160 and 161 to reverse the hydraulic connections to the rail clamp cylinders and spread cylinders.

From the foregoing description, it will be evident that the anchor spreader enables the spreading of rail-mounted anchors to a distance away from a tie whereby the tie can be removed for replacement, with the anchor spreader having the versatility to spread anchors mounted on rails that may vary in height at various locations and to operate effectively when there is an anchor present only at one side of a tie.

We claim:

1. An anchor spreader for spreading one or more rail-mounted anchors away from a tie comprising, a frame, a head assembly movably mounted on said frame for vertical movement toward and away from a tie, and spreader means movably mounted on said head assembly for engaging a pair of rail-mounted anchors at a level above the tie and moving the anchors oppositely along the rail away from the tie to spread the anchors.

2. An anchor spreader as defined in claim 1 including releasable means on said head assembly for clamping the rail to hold the head assembly against movement longitudinally of the rail during spreading of the anchors.

3. An anchor spreader as defined in claim 2 wherein said spreader means includes a plurality of fluid cylinders, said releasable clamping means includes a hydraulic cylinder, and a circuit including a pressure switch associated with the hydraulic cylinder to assure rail clamping before operation of the fluid cylinders to spread the anchors.

4. An anchor spreader as defined in claim 1 wherein said head assembly has a pair of spaced apart head guide members and a centrally positioned head plate rigidly connected thereto, said spreader means including a pair of vertically-extending spreader bars positioned between said head guide members and the head plate and each having anchor-engaging spreader plates at the lower end thereof, and a plurality of hydraulic cylinders movably connecting a spreader bar to said head plate whereby the hydraulic cylinders can move the spreader bars away from the head plate and the spreader plates away from positions adjacent the tie to spread the anchors.

5. An anchor spreader as defined in claim 4 including a pair of releasable rail-clamping means each having a hydraulic cylinder, and a control circuit for the last-mentioned hydraulic cylinder and the hydraulic cylinders for moving the spreader bars including signal-responsive valves, and a pressure switch associated with the hydraulic cylinder of the rail-clamping means for generating a signal for operation of the spreader bar cylinders after a rail is clamped.

6. An anchor spreader as defined in claim 5 wherein the hydraulic cylinders of said rail clamping means are hydraulically connected in parallel, and said pressure switch being connected into said parallel hydraulic connection whereby both of the last-mentioned hydraulic cylinders must have operated to cause operation of the spreader bar cylinders.

7. An anchor spreader as defined in claim 4 including means interposed between the spreader bars and the head guide members to limit movement of the spreader bars away from the head plate.

8. An anchor spreader as defined in claim 1 including adjustable means on the frame for setting the lowered position of the head assembly due to variations in the height of rail with which the anchor spreader is used.

9. An anchor spreader for spreading rail-mounted anchors comprising: a vehicle movable along a pair of rails and having a frame overlying said pair of rails; a head assembly having a pair of spaced-apart head guide members and a vertically-disposed head plate positioned therebetween; means movably mounting the head guide members to the frame whereby the vehicle can be positioned to align the head plate with the center line of a tie and the head assembly and head plate lowered to a position closely overlying the tie; means rigidly interconnecting said head guide members and head plate; a pair of spreader means mounted on the head assembly each comprising a pair of spreader bars each having at least one spreader plate at the lower end for engaging a part of a rail anchor extending above the top of a tie; means for moving said spreader bars in opposite directions to move a pair of rail anchors associated with each rail away from the tie, and rail-engaging clamping means for holding the head assembly against movement longitudinally of the rails as the rail anchors are forced to move lengthwise of the rails.

10. An anchor spreader as defined in claim 9 wherein the means rigidly interconnecting the head guide members and head plate of the head assembly comprises a plurality of head rods, and means movably mounting said spreader bars on said head rods.

11. An anchor spreader as defined in claim 10 wherein said means for moving said spreader bars in opposite directions comprises a plurality of hydraulic cylinders with a hydraulic cylinder and associated piston connected one to a spreader bar and one to the head plate.

12. An anchor spreader as defined in claim 11 wherein the rail-engaging clamping means comprises a plurality of movable clamps, a plurality of hydraulic cylinders associated one with each clamp, and a hydraulic circuit containing the hydraulic cylinders for the spreader bars and the movable clamps with said circuit and including pressure-responsive switches for determining that the rails have been clamped.

13. An anchor spreader as defined in claim 12 wherein there are a pair of movable clamps for engaging a rail at spaced locations, and said clamps being constructed to have one or the other increase the clamping force on a rail dependent upon the direction in which the head assembly is urged by the reaction to the spreading force applied to a rail anchor.

14. An anchor spreader as defined in claim 9 including means interposed between a spreader bar and a head guide member to limit movement of the spreader bars away from the head plate.

15. An anchor spreader as defined in claim 9 including adjustable means on the frame for setting the lowered position of the head assembly due to variations in the height of rail with which the anchor spreader is used.

* * * * *